United States Patent [19]

Jones

[11] Patent Number: 5,066,004

[45] Date of Patent: Nov. 19, 1991

[54] LEG EXTENSION EXERCISE MACHINE

[75] Inventor: Gary A. Jones, Falmouth, Ky.

[73] Assignee: Hammer Corporation, Cincinnati, Ohio

[21] Appl. No.: 573,553

[22] Filed: Aug. 27, 1990

[51] Int. Cl.[5] ..... A63B 21/00

[52] U.S. Cl. ..... 272/134; 272/132; 272/144; 128/25 R

[58] Field of Search ..... 272/118, 117, 72, 73, 272/144, DIG. 4, 123, 134, 901, 136, 130

[56] References Cited

U.S. PATENT DOCUMENTS

| | | | |
|---|---|---|---|
| 3,858,873 | 1/1975 | Jones . | |
| 3,998,454 | 12/1976 | Jones . | |
| 4,502,681 | 3/1985 | Bloomquist | 272/117 |
| 4,509,746 | 4/1985 | Mask | 272/144 |
| 4,586,510 | 5/1986 | Glaser | 272/134 |
| 4,720,099 | 1/1988 | Carlson | 272/134 |

OTHER PUBLICATIONS

Instruction Manual, Leverage Machines, Nautilus Sports, Medical Industries, Inc., P.O. Box 1783, Deland, FL. 32721-1783.

*Primary Examiner*—Richard J. Apley
*Assistant Examiner*—Jerome Donnelly
*Attorney, Agent, or Firm*—Wood, Herron & Evans

[57] ABSTRACT

A leg extension exercise machine includes a frame, a declined seat connected to the frame and two independently maneuverable levers pivotally connected to the frame in front of the seat, the levers being pivotal in vertical planes that diverge with respect to the front of the seat. Hubs at the lower, forward ends of the levers hold removable weights. Pads supported by the lower forward ends are adapted to be engaged by the fronts of the legs of a person and raised forwardly, upwardly and slightly outwardly to perform a leg extension maneuver while supported on the declined seat. The diverging vertical planes of movement accommodate the natural musculoskeletal leg movements of a person, thereby maximizing muscular benefit while minimizing joint stress.

19 Claims, 4 Drawing Sheets

LEG EXTENSION EXERCISE MACHINE

FIELD OF THE INVENTION

This invention relates to a leg extension exercise machine that accommodates the natural musculoskeltal makeup of a person.

BACKGROUND OF THE INVENTION

Many atheletes and non-athletes utilize weight lifting or weight training exercises to build strength and/or bulk, to prevent injury, or to improve overall condition and appearance. Typically, weight training exercises are performed with either exercise machines or free weights, i.e., barbells and weighted plates, dumbbells, etc. For various reasons, most exercise programs incorporate both machines and free weights in a variety of different exercise routines to maximize the effect of working out a desired number of muscle groups.

One exercise maneuver that is frequently performed on an exercise machine is referred to as a leg extension. The leg extension exercise involves extending, against a pivotal weight resistance, one leg or both legs forwardly and outwardly from a flexed position to an extended position. The exercise is performed from a seated position, and the applied force of the legs is directed against pads connected to pivotal levers. Removable weights, or a stationary stack of weights are connectable to the lever to provide a selectable weight resistance.

There are presently a number of different machines available for performing a leg extension exercise. Some leg extension machines simply utilize a lever pivotally connected to a frame which includes a horizontal support, with removable weights supported on the lever. While relatively simple in construction, these machines are rather awkward for the exerciser because the horizontal support does not provide good leverage during the leg extension motion. Moreover, the support must remain substantially flat because these machines are generally also used for performing a leg curl exercise from a prone, face-down position.

Other leg extension exercise machines utilize a pulley and cable to couple the exercise movement to the weight resistance. At least one leg extension machine uses an eccentric cam and chain mechanism for the same purpose. Leg extension machines which utilize a cable/chain linkage require periodic maintenance to prevent friction buildup, which would otherwise result in an undesired increase in resistance to extension of the legs. Moreover, these additional parts also may wear out or function improperly and thus necessitate removal and repair.

Perhaps more importantly, these other leg extension machines do not always feel right or "fit" the body properly. For instance, structural components such as the pivot point or the lever length seem to be sized disproportionately for a large number of athletes. While some portion of this awkwardness may be attributable to the fact that most exercise machines are sized or shaped for an "average" size person and many people who use these machines are simply not of "average" musculoskeletal structure, there is also another degree of awkwardness which does not seem to be size-related at all. This latter degree of awkwardness relates to unnatural musculo-skeletal positioning that results directly from the orientation of the machine itself, even for an average size individual. As a result, muscles, bones and/or joints are subjected to unnecessary shear or compression stress during exercise with these machines. This disadvantage is particularly unfortunate in the case of the leg extension exercise because the leg extension is considered critical to minimizing the risk of injury to the knee joint, one of the body's most susceptible joints.

Finally, if the knee is injured, it is considered important to perform the leg extension exercise with one leg only during rehabilitation to allow close monitoring of progress. Unfortunately, single leg performance of a leg extension exercise on most of these machines seems to accentuate the awkwardness or uncomfortable fit of the machine.

It is therefore an object of the invention to provide a leg extension exercise machine that maximizes the exercise benefit attainable during a leg extension maneuver while minimizing skeletal or joint stress associated therewith.

It is another object of the invention to provide a leg extension exercise machine that reduces or eliminates the unnatural feel that seems to be inherent with other leg extension exercise machines.

It is still another object of th invention to provide a leg extension exercise machine which is particularly suitable for exercising one leg at a time.

SUMMARY OF THE INVENTION

This invention contemplates a leg extension exercise machine that includes a frame which supports a declined seat and weight supporting levers that are pivotally connected to the frame in front of the seat. The forward ends of the levers are adapted to be pivoted upwardly with respect to the frame by the extended legs of a person declined on the seat. Pivotal movement against the resistance of the supported weights occurs in planes that diverge outwardly from the front of the machine.

Compared to prior leg extension machines, this leg extension machine better accommodates the natural musculoskeletal makeup of the human body. More particularly, the natural musculoskeletal makeup of the body is accommodated by the structural orientation of the levers, the seat, the initial starting position and the location of the pads which the legs bear against to move the levers. The particular combination of all of these structural aspects results in a machine which, based upon feedback from a number of individuals involved in the field of strength training, more naturally couples the muscular exertions of the leg extension against a preselected weight resistance and in a direction of motion that is compatible with the musculoskeletal structural makeup of the body.

Because it has two independently pivotal levers, this leg extension machine enables the performance of either simultaneous or alternate exercise of both legs. This feature is particularly important in monitoring rehabilitation progress after an injury, especially a knee injury, where it is often necessary to compare the relative strengths of the legs.

In a related aspect of this feature, the initial angle of the forward end of the lever and the counterweight at the rearward end of the levers substantially counterbalance the weights supported at the lower forward ends of the respective levers. As a result, for each lever, the initial moment arm about the pivot axis is close to zero, and the minimum weight that must be exercised against, i.e., with no weight plates supported, is very low.

Therefore, and also because the pivotal lever has substantially no friction, the weights supported on the lever closely approximate the actual weight resistance that is exercised against. This feature becomes important during the initial stages of rehabilitation, when it may be required to exercise against very low weight resistance and keep highly accurate records of actual weight lifted.

This feature also constitutes an advantage over leg extension machines that utilize a pulley or chain linkage, wherein the minimum weight resistance is often greater than the desired amount of initial resistance.

In accordance with a preferred embodiment of the invention, a leg extension exercise machine includes a frame, a declined seat connected to the frame and two levers pivotally connected to the frame in front of the seat. Lower, forward ends of the levers include hubs for holding weighted plates. Arms extend inwardly and rearwardly from the lever forward ends, and pads mounted to the arms are adapted to be engaged and moved upwardly by the legs of a person supported on the seat. The initial location of the pads with respect to the front edge of the sea provides a natural position for coupling an applied, upward leg extension force to two outwardly diverging vertical planes of lever motion. That is, the levers pivot along outer vertical planes that diverge with respect to the forward facing direction of the seat, or with respect to a vertical midplane that bisects the seat.

Compared to prior leg extension machines, these outer vertical planes more naturally accommodate the structure of the human body relative to the leg extending motion utilized in a leg extension exercise. As a result, a person supported on the seat is able to maximize the muscular benefits attainable by performing a leg extension exercise, while minimizing joint stress. Use of this invention provides exercise for a muscle group that includes the quadriceps and the muscle and tissue that surrounds and supports the knee joint.

The structural orientation of this leg extension exercise machine evolved from applicant's belief that most exercise machines, including leg extension exercise machines, oversimplify the musculoskeletal movements of the human body While his accumulated years of observing and analyzing athletic movements of the body led him to conclude that most musculoskeletal movements are rather complex and involve multiple joints and multiple degrees of freedom, he also recognized that most exercise machines require bodily movement in directions or planes that are oriented simply at right angles or parallel to the torso of the body. Based on these observations, and bolstered by his opinion that the ultimate objective of any exercise machine is to provide maximum muscular benefit with minimum joint stress, applicant perceived a need for improvement in the design of exercise machines and began working toward that goal. Feedback from athletes who have used this inventive leg extension exercise machine has confirmed that it constitutes an improvement over pre-existing leg extension exercise machines.

With this machine, for persons of average size, the moment arm created by the lever about the pivot point is lowest upon initiation of the extension motion and it increases gradually throughout the motion until the lever is parallel with the ground. The moment arm about the pivot point begins decreasing again from the maximum value as the lever is rotated above the horizontal position.

According to another feature of the invention, a removable pin is provided for each lever to limit the range of the exercise motion by limiting downward pivotal motion of the lever.

These and other features of the invention will be more readily understood in view of the following detailed description and the drawings.

DETAILED DESCRIPTION OF THE DRAWINGS

Figure 1:
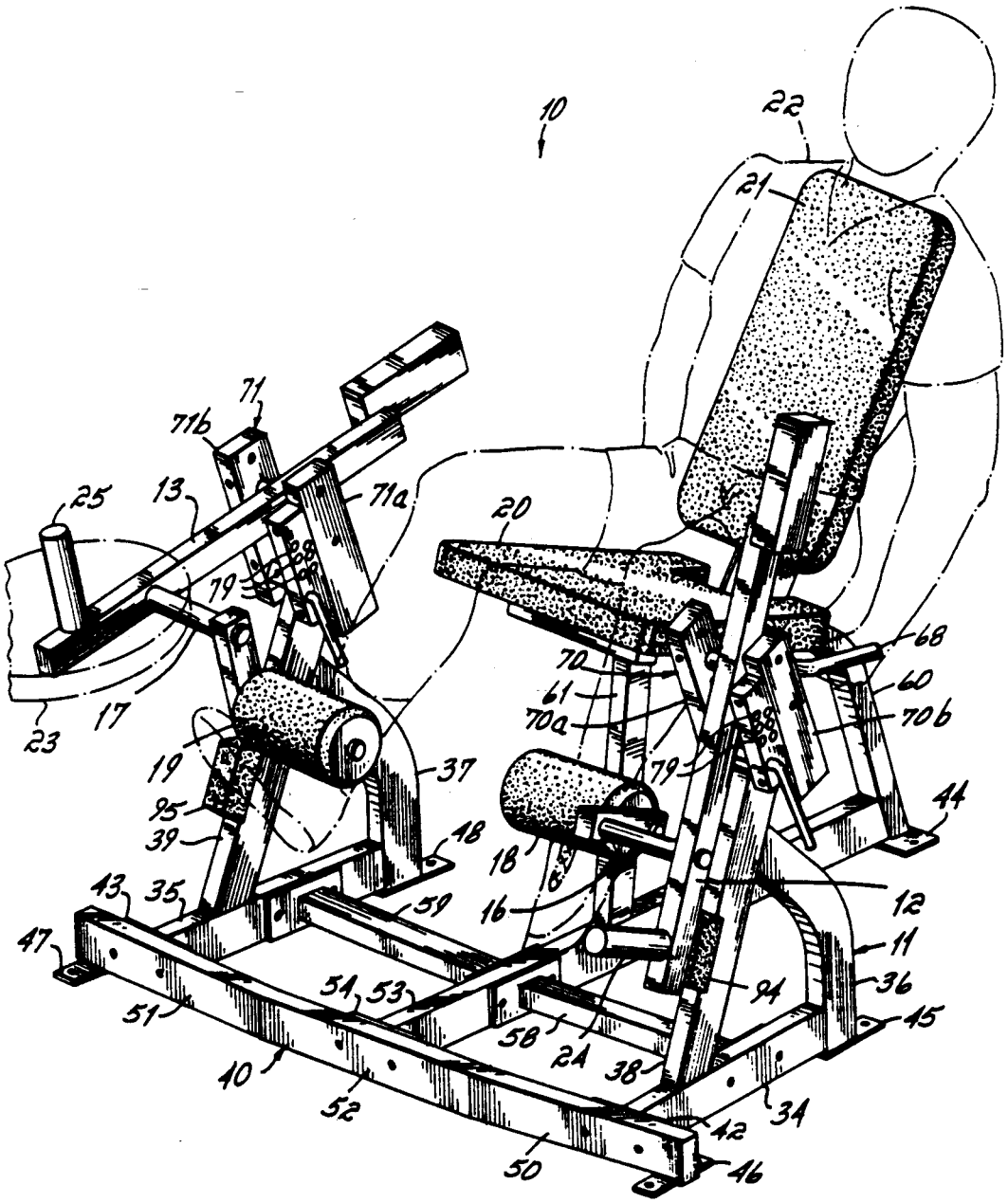
FIG. 1 is a perspective view of a leg extension exercise machine in accordance with a preferred embodiment of th invention.

FIGS. 1–4 show a leg extension exercise machine 10 in accordance with a preferred embodiment of the invention. This machine 10 includes a frame 11 made of a number of straight and/or curved sections of heavy duty steel that are either welded or bolted together, or pivotally connected. Leg extension levers 12 and 13 are connected to the frame 11 for pivotal movement about hinge axes 14 and 15 (FIG. 4), respectively. Connector arms 16 and 17 extend inwardly and then rearwardly from levers 12 and 13, respectively. Pads 18 and 19 are mounted to the ends of the connector arms 16 and 17, respectively. Preferably, the pads are rotatable with respect to the connector arms. The frame 11 also supports a declined seat 20 and declined back rest 21. Because the connector arms 16 and 17 extend inwardly from the respective levers, the machine is easier to get into than most prior leg machines, due to the fact that there is some open space between the levers. By slightly raising of one of the levers, an exerciser is able to get into the seat 20 from the front. This feature may be important for individuals who are restricted by a leg cast or a leg immobilizer, or required to use crutches.

An exerciser 22 supported on the seat 20 places his or her legs behind the pads, with the fronts of the shins bearing against the pads and exercises the legs through a leg extension motion by alternately or simultaneously pivoting the levers forwardly, upwardly and slightly outwardly against the weight resistance provided by removable weight plates 23 supported on hubs 24 and 25 at the lower, forward ends of the levers 12 and 13, respectively. The rearward ends of levers 12 and 13 include counter-weights 30 and 31, respectively.

The frame 11 is bisected by a vertical midplane 27 (shown in FIG. 2) that extends through the middle of the frame 11. Basically the frame 11 includes two sides that are mirror images with respect to the vertical midplane 27. The sides are oriented along planes 28 and 29 that diverge with respect to the forward direction of the seat 20. This angle of divergence is preferably about 5°. Each side has a bottom support, a rear leg and a front leg. On the left side of the frame 11, as viewed by one supported on seat 20 and back rest 21, these parts are numbered 34, 36 and 38, respectively. Similarly, on the right side of frame 11 these parts are numbered 35, 37 and 39, respectively. The metal sections forming the sides are preferably connected together by welds.

Bottom legs 34 and 35 are connected at their forward ends to a forward base section 40. Preferably, connection is made by bolts (not shown) tightened through end plates 42 and 43 that are welded to legs 34 and 35, respectively. The frame 11 is also supported at its corners by welded bottom plates 44, 45, 46, 47 and 48. Preferably, these bottom plates have bolt holes for optional securement of the machine 10 to a portable base.

The forward base section 40 includes outer portions 50 and 51 that are angled rearwardly with respect to a central portion 52. The angles of these portions 50 and 51 determine the angles of divergence of the sides of the frame 11, and ultimately, the angles of the vertical planes of movement of the levers 12 and 13, respectively. A middle section 53 is connected to central portion 52, preferably by a plate 54 welded at its forward end. Middle section 53 is connected on its sides to legs 34 and 35 by lateral sections 58 and 59, respectively. Connection is preferably via plates welded onto the ends of the lateral sections 58 and 59.

Figure 3:
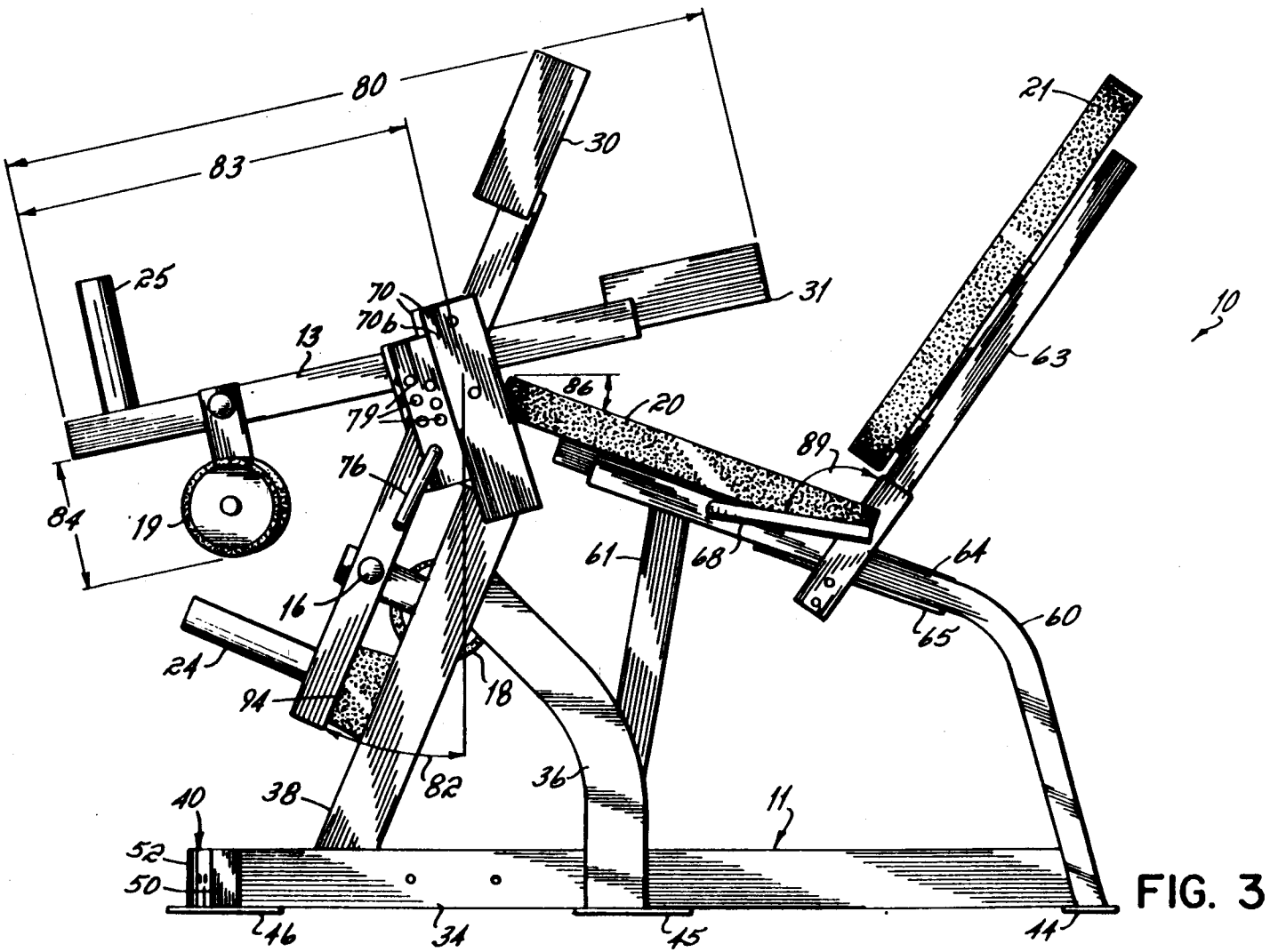
FIG. 3 is a side view of the leg extension exercise machine shown in FIG. 1.
Figure 4:
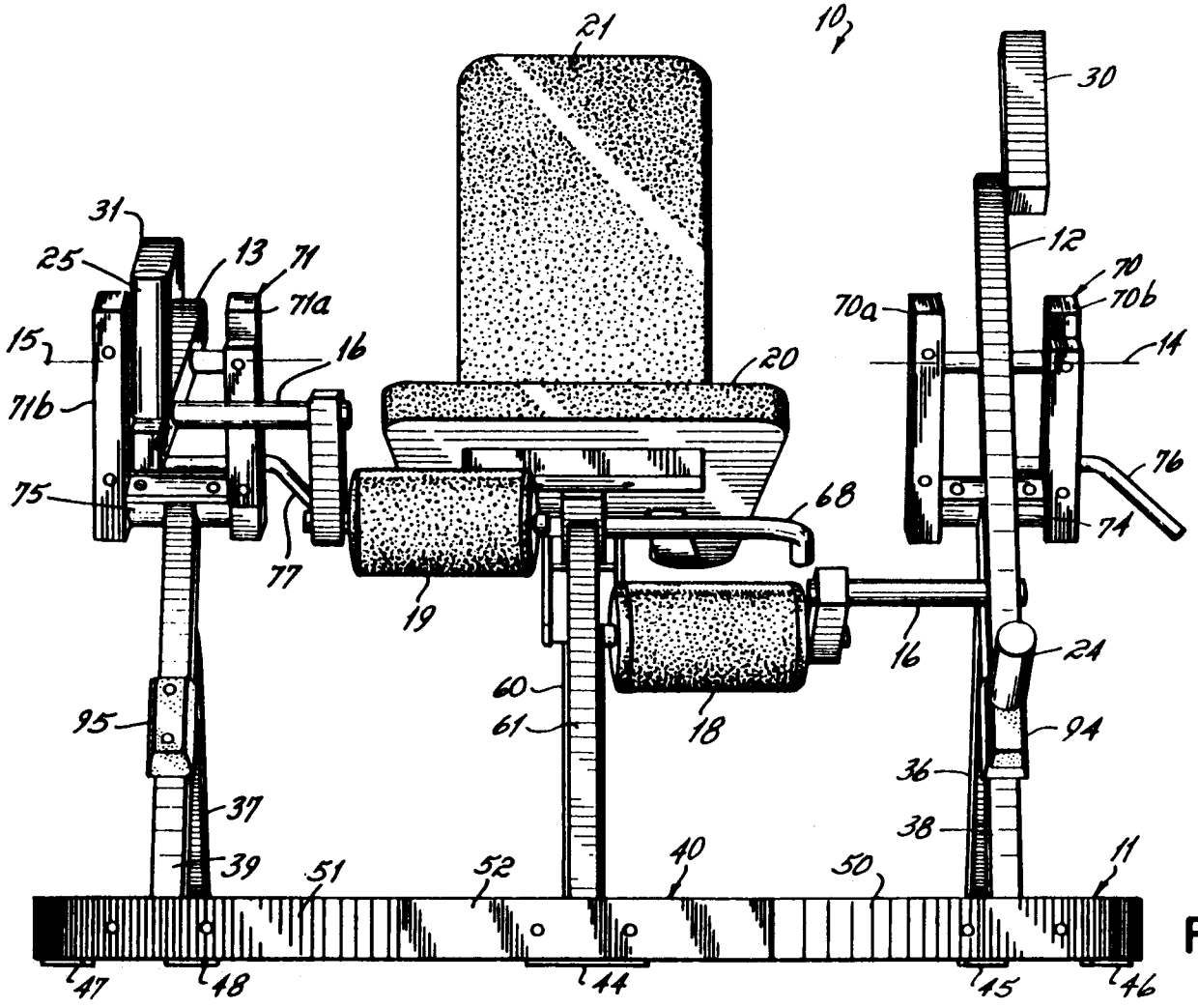
FIG. 4 is a front view of the leg extension exercise machine shown in FIG. 1.

Seat 20 and back rest 21 are connected to a central leg 60 that extends along the vertical mid-plane 27. Central leg 60 is connected to the rear end of middle section 53, and it extends forwardly, with an intermediate bend, to define the declined angle of the supported seat 20. The declined angle of the seat 20 is preferably about 20° from horizontal, as shown in FIG. 3. Central leg 60 is supported at its forward end by center brace 61. The back rest 21 is connected to center leg 60 via rear support 63, as shown in Fig. 3. Back rest 21 and rear support 63 are declined from the forward portion of center leg 60 at an angle of about 105°. This places back rest 21 at a declined angle of about 125° from horizontal.

Figure 2:
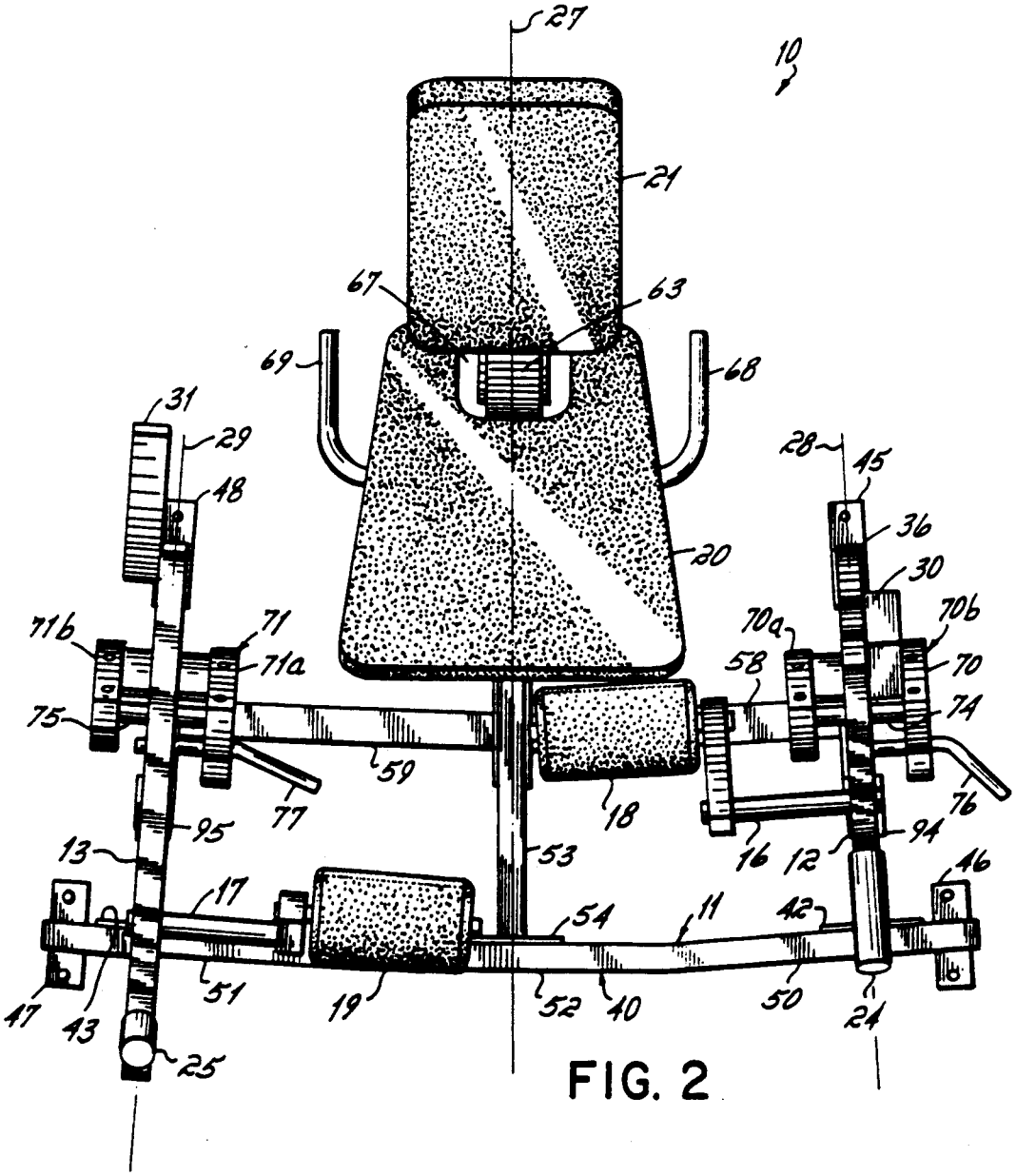
FIG. 2 is a top view of the leg extension exercise machine shown in FIG. 1.

If desired, the position of the back rest 21 may be made adjustable along leg 60. Such adjustment could be provided by frictional engagement between parallel spaced bars (not shown) connected to support 63 and two planar pieces 64 and 65 that are secured to central leg 60 in a sandwiching arrangement. Handles 68 and 69 are also connected to support 63, and the handles assist the exerciser in adjusting the seat back 21 along leg 60. A central opening or cutout 67 (FIG. 2) is provided in the central rear section of seat 20 to allow unobstructed forward movement of support 63 during forward adjusting, as shown in FIG. 2.

To raise or lower the seat back 21, a top end of the seat back 21 is tilted forwardly with respect to central leg 60 so that the spaced parallel bars move away from, or provide clearance from pieces 64 and 65. In this orientation, the seat back 21 may be moved upwardly o downwardly along the planar pieces, or along leg 60. When the top end is subsequently tilted rearwardly, the parallel bars of support 63 will frictionally engage the sandwiching pieces 64 and 65. This may be done by the exerciser, from a seated position, by reaching back and tilting the top of the seat back 21 forwardly via the handles 68 and 69, and then pulling the member 63 forwardly along leg 60 until the seat back 21 contacts his or her back. Any number of other methods for providing adjustability for seat 20 along leg 60 would be equally suitable, if it is desired to provide this feature.

The levers 12 and 13 are hingedly connected to diagonal mounting brace pairs 70 and 71, respectively, by bearings. A pillow block bearing sold by Browning, Part No. VF 2S 116 has proved suitable. These bearings require maintenance only once a year, maintenance which consists of one shot of lubricating oil.

The diagonal mounting brace pairs 70 and 71 are rigidly connected to frame 11 by horizontal mounting braces 74 and 75, respectively. The brace pairs include inner braces **70*a* and 71*a* and outer braces 70*b* and 71*b*. Removable pin 76 may be inserted into on of the mounting holes 78 formed in outer brace 70*b*, while a removable pin 77 may be inserted into one of the mounting holes 79 formed in brace 71*b***. These pins provide selectability in limiting downward pivotal movement of the levers. This feature is particularly useful in rehabilitating a knee injury. At the highest mounting hole, downward pivotal movement is maximally restricted, and the initial angle of the lever is about 60° from vertical.

Each lever 12 and 13 preferably has a total length, including the counterweight, of about 38". This total length is designated by numeral 80 in FIG. 3. The initial downward angle of each lever is about 20° from vertical. This angle is designated by numeral 82 and also shown in FIG. 3. This angle may be increased, as described above, depending upon placement of the pins. The levers are hingedly connected to the respective mounting brace pairs at a distance of about 21" from their forward ends. This distance is designated by numeral 83. The perpendicular distance from the contacting surface of the pads 18 and 19 to levers 12 and 13, respectively, is designated by numeral 84, and is preferably about 8".

As indicated previously, the seat back 2 is preferably declined from the central leg 60 and seat 20 at an angle of about 20°. This angle is designated by numeral 86. The handles have rearward ends connected to rearward support 63, and they extend forwardly and downwardly. Each of the handles angles downwardly from support 63 at an angle of about 115°, designated by numeral 89. Grasping of the handles provides leverage for an exerciser during performance of a leg extension exercise.

A rubber stop 94 mounted to leg 38 limits downward pivotal movement of lever 12. Similarly, a rubber stop 95 mounted to leg 39 limits downward pivotal movement of lever 13. The stops only limit downward pivotal motion when the pins 76 and 77 are not used.

The angles of the seat 20 and seat back 21, with respect to frame 11, and the location of the seat 20 and seat back 21 with respect to the pivot axes 14 and 15, enable motive force of the leg extension motion to be applied in two diverging planes which, compared to prior leg extension machines, more naturally accommodate the musculoskeletal structure of a human being.

As mentioned previously, frame 11 enables a person to perform a leg extension exercise either simultaneously with both legs or independently with one leg at a time, which provides a significant advantage over prior leg extension machines. Moreover, because the counterweights enable a very low weight to be exercised against, this leg extension machine is particularly advantageous for rehabilitation of a knee injury.

While a preferred embodiment of the invention has been described, it is to be understood that the invention is not limited thereby and that in light of the present disclosure, various other alternative embodiments will be apparent to a person skilled in the art. For instance, the exact structural orientation of some of the parts or portions of the frame 11 is not critical, so long as the positioning of the seat with respect to two diverging vertical planes of motion is maintained. Additionally, while the particular angles of the vertical planes of movement shown in the Figs. are considered to be optimum at this point in time, based upon feedback from those involved in strength training, it is entirely possible that some further refinements may evolve. Accordingly, it is to be understood that changes may be made without departing from the scope of the invention as particularly set forth and claimed.

I claim:

1. A leg extension exercise machine comprising:
a frame;
a seat supported by the frame in alignment with a vertical midplane through the frame;
a lever pivotally connected to the frame, a forward end of the lever adapted to hold a removable weight and adapted to be pivotally raised upwardly by the leg of a person supported on the seat, the level being pivotal through a vertical plane of movement which diverges outwardly from the vertical midplane with respect to a forward facing direction of the seat.

2. The leg extension exercise machine of claim 1 wherein the vertical plane of movement diverges from the vertical midplane at an angle of about 5°.

3. The leg extension exercise machine of claim 1 wherein the lever is pivotally connected to the frame at a central pivot point and said forward end pivots forwardly from an initial angle of about 20° from vertical.

4. The leg extension exercise machine of claim 1 and further comprising:
means for selectively adjusting the initial angle of the lever, thereby to limit the range of pivotal motion of the lever.

5. The leg extension exercise machine of claim 1 wherein the lever has a rearward end that includes a counterweight.

6. The leg extension exercise machine of claim 1 and further comprising:
a connector arm connected to the forward end of the lever and extending toward the midplane; and
a pad supported on the connector arm and adapted to be acted upon by the leg of a person supported on the seat to pivotally raise the lever, the pad spaced from the vertical midplane to facilitate forward accessibility of the seat to the exerciser.

7. The leg extension exercise machine of claim 4 wherein the pad is spaced from the lever at a distance of about 8".

8. The leg extension exercise machine of claim 1 wherein the seat is declined with respect to the frame.

9. The leg extension exercise machine of claim 1 wherein the seat comprises back and bottom supports.

10. The leg extension exercise machine of claim 9 wherein said bottom support is declined about 20° from horizontal.

11. The leg extension exercise machine of claim 9 wherein said back support is declined about 125° from horizontal.

12. The leg extension exercise machine of claim 8 wherein the back and bottom supports have an angle of about 105° therebetween.

13. The leg extension exercise machine of claim 9 and further comprising:
a center leg supporting the back and bottom supports, and
means for slidably adjusting the back support along the center leg.

14. The leg extension exercise machine of claim 13 wherein the back support further includes a pair of handles, thereby to facilitate slidable adjustment of the back support along the center leg.

15. The leg extension exercise machine of claim 13 wherein said bottom support has a centrally located cutout section to accommodate forward adjustment of the back support 16. A leg extension exercise machine comprising:
a frame;
a declined seat supported by the frame along a vertical midplane, the seat including a bottom portion and a back portion; and
a pair of levers pivotally connected to the frame, each lever having a forward end adapted to hold at least one removable weight and adapted to be pivotally raised upwardly by the leg of a person supported on the declined seat, the levers being pivotal in outer vertical planes that diverge outwardly from the vertical midplane with respect to the forward facing direction of the seat.

17. The leg extension machine of claim 16 and further comprising:
a declined central leg supporting said bottom and said back portions of said seat; and
means for adjusting said back portion along said central leg.

18. The leg extension machine of claim 17 wherein said bottom portion has a centrally located cutout section to accommodate forward adjustment of said back portion along said central leg.

19. The leg extension machine of claim 16 and further comprising:
a pair of connector arms, each connector arm extending inwardly from a respective forward end of a lever and adapted to support a pad that is acted upon by an exerciser during a leg extension exercise, the pads and connector arms being spaced from the vertical midplane to facilitate forward access to the seat for the exerciser.

* * * * *

UNITED STATES PATENT AND TRADEMARK OFFICE

CERTIFICATE OF CORRECTION

PATENT NO. : 5,066,004

DATED : 11-19-91

INVENTOR(S) : Gary A. Jones

It is certified that error appears in the above-identified patent and that said Letters Patent is hereby corrected as shown below:

Column 3, Line 23 should read "of the seat provides" instead of "of the sea provides".

Column 5, Line 51 should read "upwardly or" instead of "upwardly o".

Column 6, Line 28 should read "seat back 21 is" instead of "seat back 2 is".

Signed and Sealed this

Fifth Day of October, 1993

Bruce Lehman

*Attest:*

BRUCE LEHMAN

*Attesting Officer*

*Commissioner of Patents and Trademarks*